US007649308B2

(12) United States Patent
Lee et al.

(10) Patent No.: US 7,649,308 B2
(45) Date of Patent: Jan. 19, 2010

(54) ELECTRON EMISSION DEVICE AND METHOD FOR MANUFACTURING THE SAME

(75) Inventors: Sang-Jo Lee, Suwon-si (KR); Chun-Gyoo Lee, Suwon-si (KR); Sang-Hyuck Ahn, Suwon-si (KR); Su-Bong Hong, Suwon-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 469 days.

(21) Appl. No.: 11/348,739

(22) Filed: Feb. 6, 2006

(65) Prior Publication Data

US 2006/0192477 A1 Aug. 31, 2006

(30) Foreign Application Priority Data

Feb. 28, 2005 (KR) ..... 10-2005-0016846

(51) Int. Cl.
*H01J 1/62* (2006.01)

(52) U.S. Cl. ..... 313/497; 313/310

(58) Field of Classification Search ..... 313/309–311, 313/326, 336, 351, 495–497
See application file for complete search history.

(56) References Cited

U.S. PATENT DOCUMENTS 6,737,792 B2 * 5/2004 Saito et al. ..... 313/310
7,279,830 B2 * 10/2007 Lee et al. ..... 313/497
7,352,123 B2 * 4/2008 Ahn et al. ..... 313/496
2002/0167265 A1 * 11/2002 Miyata et al. ..... 313/495
2003/0127988 A1 * 7/2003 Jo et al. ..... 315/169.3
2004/0104668 A1 * 6/2004 Lee et al. ..... 313/496
2004/0189183 A1 * 9/2004 Hu et al. ..... 313/497
2004/0222734 A1 * 11/2004 Oh ..... 313/497

* cited by examiner

*Primary Examiner*—Nimeshikumar D. Patel
*Assistant Examiner*—Mary Ellen Bowman
(74) *Attorney, Agent, or Firm*—Christie Parker & Hale, LLP

(57) ABSTRACT

An electron emission device includes first electrodes formed on a substrate and oriented in a first direction of the substrate, and isolated electrodes disposed on a same plane as the first electrodes while being spaced apart from the first electrodes. The isolated electrodes are separately formed and arranged in the first direction as well as in a second direction crossing the first direction. Line electrodes are placed on a different plane from the first electrodes and the isolated electrodes and are disposed on an insulating layer. Each of the line electrodes is electrically connected to a respective plurality of the isolated electrodes arranged along the second direction to form a second electrode together with the respective plurality of the isolated electrodes. Electron emission regions are formed on the isolated electrodes along the peripheral sides of the isolated electrodes proximate to the first electrodes.

20 Claims, 12 Drawing Sheets

ELECTRON EMISSION DEVICE AND METHOD FOR MANUFACTURING THE SAME

CROSS REFERENCE TO RELATED APPLICATION

This application claims priority to and the benefit of Korean Patent Application No. 10-2005-0016846 filed on Feb. 28, 2005 in the Korean Intellectual Property Office, the entire content of which is incorporated herein by reference.

BACKGROUND OF THE INVENTION

1. Field of the Invention

The present invention relates to an electron emission device, and in particular, to an electron emission device which involves improved structure of electron emission regions and driving electrodes to enhance the emission efficiency, and a method of manufacturing the electron emission device.

2. Description of Related Art

Generally, electron emission devices are classified into those using hot cathodes as an electron emission source, and those using cold cathodes as the electron emission source. There are several types of cold cathode electron emission devices, including a field emitter array (FEA) type, a metal-insulator-metal (MIM) type, a metal-insulator-semiconductor (MIS) type, and a surface conduction emitter (SCE) type.

The MIM type and the MIS type electron emission devices have a metal/insulator/metal (MIM) electron emission region and a metal/insulator/semiconductor (MIS) electron emission region, respectively. When voltages are applied to the metallic layers or to the metallic and the semiconductor layers, electrons are migrated and accelerated from the metallic layer or the semiconductor layer having a high electric potential to the metallic layer having a low electric potential, thereby making the electron emission.

The SCE type electron emission device includes first and second electrodes arranged on a substrate parallel to each other, and a conductive thin film disposed between the first and the second electrodes. Micro-cracks are made at the conductive thin film to form electron emission regions. When voltages are applied to the electrodes while making an electric current flow to the surface of the conductive thin film, electrons are emitted from the electron emission regions.

The FEA type electron emission device is based on the principle that when a material having a low work function or a high aspect ratio is used as an electron emission source, electrons are easily emitted from the material due to the electric field under the vacuum atmosphere. A sharp-pointed tip structure based on molybdenum Mo or silicon Si, or a carbonaceous material, such as carbon nanotube has been developed to be used as the electron emission region.

The electron emission device using the cold cathode basically has first and second substrates forming a vacuum vessel, and electron emission regions formed on the first substrate together with driving electrodes for controlling the electron emission of the electron emission regions. Phosphor layers are formed on the second substrate together with an anode electrode for accelerating the electrons emitted from the first substrate toward the phosphor layers, thereby displaying the desired images.

The FEA type electron emission device has cathode and gate electrodes as the driving electrodes. The cathode and the gate electrodes are placed on different planes with an insulating layer therebetween. Any one of the cathode and the gate electrodes receives a scan driving voltage, and the other electrode receives a data driving voltage such that electrons are emitted from the electron emission regions connected to the cathode electrode.

It is necessary with the FEA type electron emission device that the emission efficiency should be enhanced to realize a high luminance display screen. The emission efficiency is determined depending upon various factors, such as a contact resistance between the cathode electrode and the electron emission region, the dimension of the effective electron emission portion of the electron emission region, and the distance between the electron emission region and the gate electrode.

In case the contact resistance between the cathode electrode and the electron emission region is high, it becomes difficult to apply the required electric current to the electron emission regions, so the emission efficiency is deteriorated. The effective electron emission portion is the portion of the electron emission region where the electron emission is intensive. The emission efficiency increases as the effective electron emission increases. Furthermore, the strength of the electric field formed around the electron emission regions increases as the distance between the electron emission region and the gate electrode decreases, thereby enhancing the emission efficiency.

However, with the above-described electron emission device, the above factors are not all optimized, and hence, enhancement of the emission efficiency is limited so that a high luminance display screen cannot be obtained. Of course, it is possible to solve such a problem by heightening the driving voltage. However, in such a case, power consumption is increased, and high cost drivers should be used, resulting in increased production cost of the electron emission device.

SUMMARY OF THE INVENTION

In one exemplary embodiment of the present invention, there is provided an electron emission device which enhances the structure of electron emission regions and driving electrodes to thereby heighten the emission efficiency. A method of manufacturing the electron emission device is provided in another embodiment.

In an exemplary embodiment of the present invention, the electron emission device includes first electrodes formed on a substrate and oriented in a first direction of the substrate, and isolated electrodes disposed on a same plane as the first electrodes while being spaced apart from the first electrodes. The isolated electrodes are separately formed and arranged in the first direction as well as in a second direction crossing the first direction. Line electrodes are placed on a different plane from the first electrodes and the isolated electrodes and are disposed on an insulating layer. Each of the line electrodes is electrically connected to a respective plurality of the isolated electrodes arranged along the second direction to form a second electrode together with the respective plurality of the isolated electrodes. Electron emission regions are formed on the isolated electrodes along peripheral sides of the isolated electrodes proximate to the first electrodes.

The isolated electrodes, in one embodiment, are separately located at respective pixel regions defined on the substrate.

In one embodiment, a distance between the substrate and the line electrodes is larger than a distance between the substrate and the first electrodes as well as the isolated electrodes. The insulating layer may be formed under the line electrodes with a same width as the line electrodes, or on an entire surface of the substrate with openings for passing the electron beams.

The first electrodes and the electron emission regions may be spaced apart from each other by a gap of 1-30 μm.

In another exemplary embodiment of the present invention, the electron emission device includes first electrodes formed on a substrate and oriented in a first direction of the substrate, and isolated electrodes placed on a same plane as the first electrodes while being spaced apart from the first electrodes. The isolated electrodes are separately formed and arranged in the first direction as well as in a second direction crossing the first direction. Line electrodes are placed on a different plane from the first electrodes and the isolated electrodes and are disposed on an insulating layer. Each of the line electrodes is electrically connected to a respective plurality of the isolated electrodes arranged along the second direction to thereby form a second electrode together with the respective plurality of the isolated electrodes. Electron emission regions are formed on the first electrodes along peripheral sides of the first electrodes proximate to the isolated electrodes.

In still another exemplary embodiment of the present invention, the electron emission device includes first electrodes formed on a substrate and oriented in a first direction of the substrate, and isolated electrodes disposed on a same plane as the first electrodes while being spaced apart from the first electrodes. The isolated electrodes are separately formed and arranged in the first direction as well as in a second direction crossing the first direction. Line electrodes are placed over the first electrodes and the isolated electrodes and are disposed on an insulating layer. Each of the line electrodes is electrically connected to a respective plurality of the isolated electrodes arranged along the second direction through a via hole formed in the insulating layer to thereby form a second electrode together with the respective plurality of the isolated electrodes. Electron emission regions may be formed on the first electrodes or the isolated electrodes.

The electron emission regions have peripheries aligned with peripheral sides of the first electrodes proximate to the isolated electrodes, or to peripheral sides of the isolated electrodes proximate to the first electrodes. The first electrodes may be spaced apart from the isolated electrodes by a gap of 1-30 μm.

In one embodiment of a method of manufacturing the electron emission device, first electrodes are formed on a substrate in a first direction of the substrate, and isolated electrodes are separately formed and arranged in the first direction as well as in a second direction crossing the first direction such that the isolated electrodes are spaced apart from the first electrodes by a predetermined distance. An insulating layer is formed on the substrate such that the insulating layer partially covers the first electrodes and the isolated electrodes. Via holes are formed in the insulating layer while partially exposing a surface of the isolated electrodes. Line electrodes are formed on the insulating layer such that the line electrodes are electrically connected to the isolated electrodes through the via holes, thereby forming second electrodes with the isolated electrodes and the line electrodes. Electron emission regions are formed on the first electrodes or the isolated electrodes.

DETAILED DESCRIPTION

Figure 1:
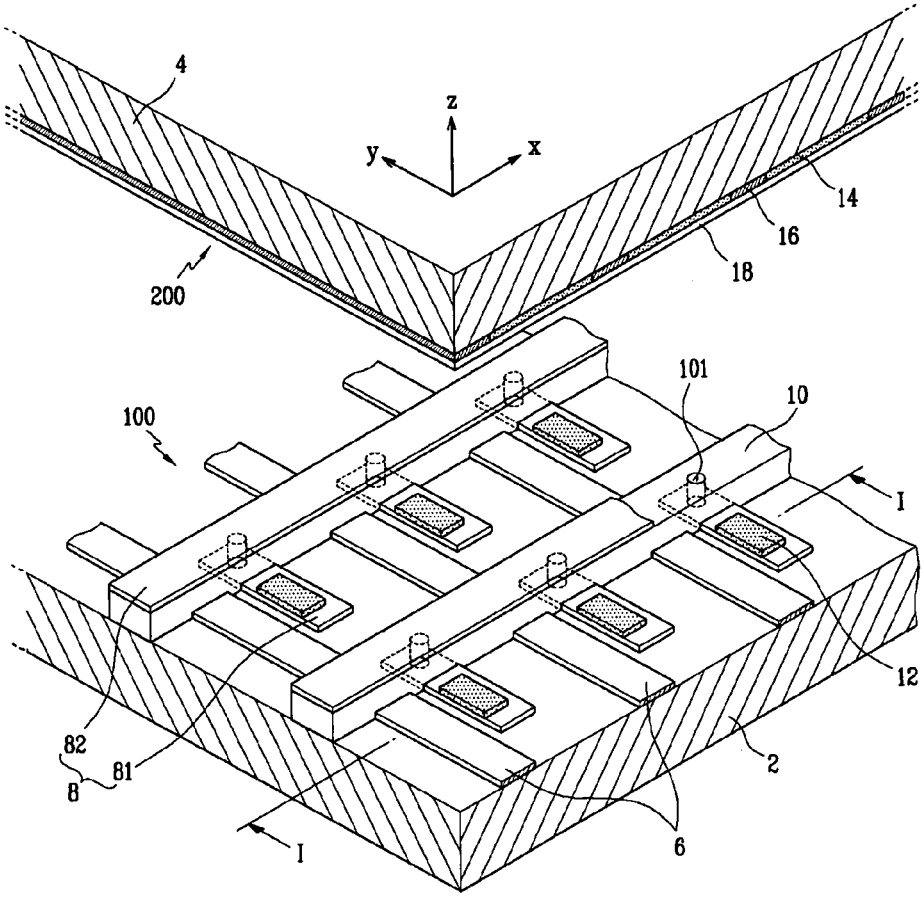
FIG. 1 is a partial exploded perspective view of an electron emission device according to a first embodiment of the present invention.
Figure 2:
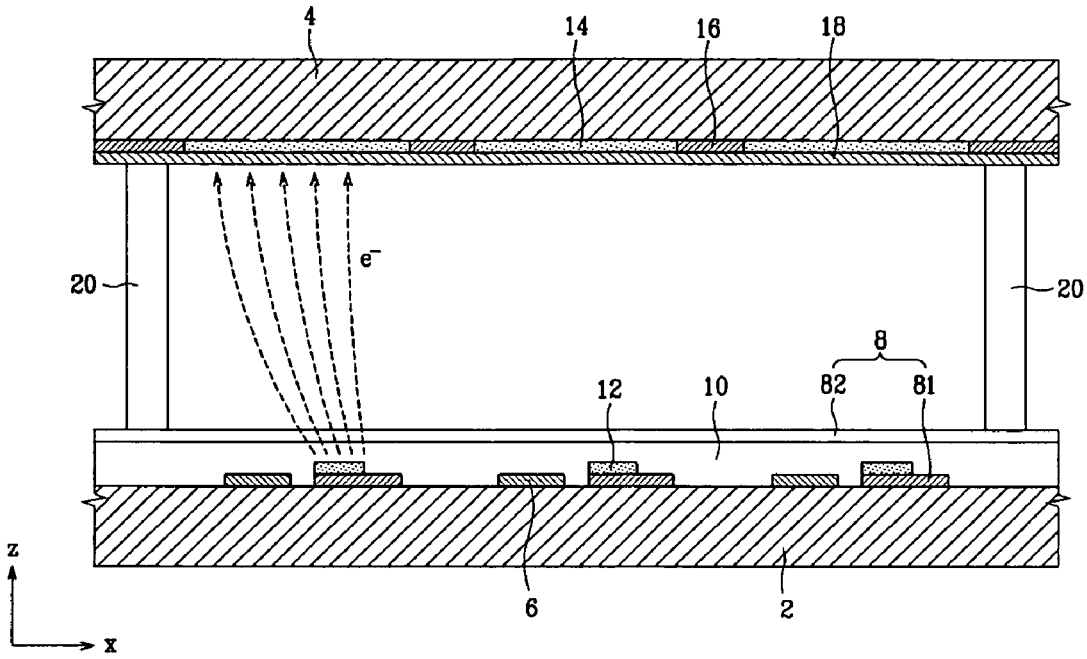
FIG. 2 is a partial sectional view of the electron emission device taken along the I-I line of FIG. 1.
Figure 3:
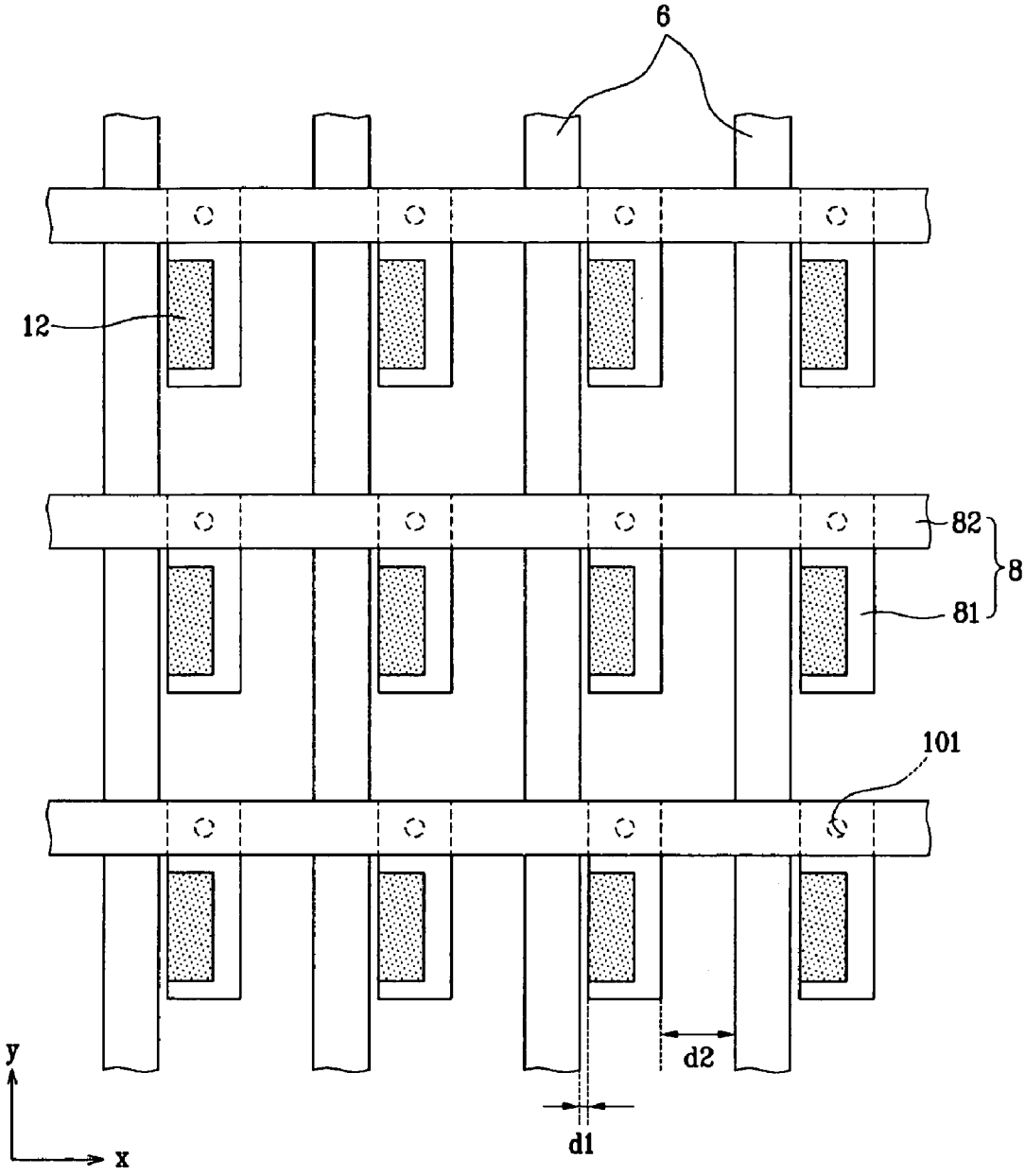
FIG. 3 is a partial plan view of an electron emission unit for the electron emission device according to the first embodiment of the present invention.

As shown in FIGS. 1 to 3, the electron emission device includes first and second substrates 2 and 4 arranged parallel to each other with a predetermined distance therebetween. A sealing member (not shown) is provided at the peripheries of the first and the second substrates 2 and 4 to seal the two substrates to each other. That is, the first and the second substrates 2 and 4, and the sealing member form a vacuum vessel.

An electron emission unit 100 is provided on a surface of the first substrate 2 facing the second substrate 4 to emit electrons toward the second substrate 4, and a light emission unit 200 is provided on a surface of the second substrate 4 facing the first substrate 2 to emit visible rays due to the electrons, thereby causing the light emission or displaying to occur.

Gate electrodes 6 are stripe-patterned on the first substrate 2 in a first direction of the first substrate 2, and isolated electrodes 81 of cathode electrodes 8 are separately located at the respective pixel regions defined on the first substrate 2 while being spaced apart from the gate electrodes 6 with a predetermined distance therebetween.

The isolated electrodes 81 may be rectangular-shaped with a pair of long sides extending parallel to the longitudinal direction of the gate electrodes 6, and a pair of short sides extending parallel to the width direction of the gate electrodes 6. In case an isolated electrode 81 is spaced apart from a gate electrode 6 at a pixel with a distance of d1 shown in FIG. 3, it is spaced apart from the gate electrode 6 at the pixel neighbors with a distance of d2 shown in FIG. 3, which is larger than the distance of d1.

An insulating layer 10 with predetermined width and thickness is formed perpendicular to the gate electrodes 6 while partially covering the gate electrodes 6 and the isolated electrodes 81, and line electrodes 82 of the cathode electrodes 8 are formed on the insulating layer 10.

The isolated electrodes 81 and the line electrodes 82 are electrically connected to each other to thereby form cathode electrodes 8. For this purpose, via holes 101 are formed at the insulating layer 10 at the respective crossed regions of the isolated electrodes 81 and the line electrodes 82. The isolated electrodes 81 placed along the length of the line electrodes 82 contact the line electrodes 82 through the via holes 101, and are electrically connected thereto.

Consequently, the cathode electrodes 8 are insulated from the gate electrodes 6, and the isolated electrodes 81 are placed on the same plane as the gate electrodes 6 while extending in parallel thereto. The line electrodes 82 are placed on the plane different from the gate electrodes 6 with an insulating layer 10 interposed between them. That is, the line electrodes 82 are placed over the gate electrodes 6. The pixel regions correspond to or are defined by the crossed regions of the gate and the line electrodes 6 and 82 in one to one correspondence manner.

Electron emission regions 12 are formed on the isolated electrodes 81 along the peripheral sides of the isolated electrodes 81 proximate to the gate electrodes 6 at the respective pixels. Accordingly, the electron emission region 12 is spaced apart from the gate electrode 6 at the respective pixel with a gap of d1, and contacts the isolated electrode 81 with a sufficient contact area, thereby minimizing the contact resistance thereof with the isolated electrode 81.

In this embodiment, the electron emission regions 12 are formed with a material that emits electrons when an electric field is applied thereto under the vacuum atmosphere, such as a carbonaceous material, and a nanometer-sized material. The electron emission regions 12 may be formed with carbon nanotube, graphite, graphite nanofiber, diamond, diamond-like carbon, $C_{60}$, silicon nanowire or a combination thereof, by way of screen-printing, direct growth, chemical vapor deposition, or sputtering.

As described above, in this embodiment, the cathode electrodes 8 have isolated electrodes 81 placed on the same plane as the gate electrodes 6 and overlaid with the electron emission regions 12, and line electrodes 82 placed on the plane different from the gate electrodes 6 and receiving the driving voltage from the outside to apply the electric current required for emitting electrons to the isolated electrodes 81.

Phosphor layers 14 and black layers 16 are formed on a surface of the second substrate 4 facing the first substrate 2, and an anode electrode 18 is formed on the phosphor layers 14 and the black layers 16 with a metallic material, such as aluminum (Al). The anode electrode 18 receives the high voltage required for accelerating the electron beams from the first substrate, and reflects the visible rays radiated from the phosphor layers 14 toward the first substrate 2 back to the second substrate 4, thereby increasing the screen luminance.

Alternatively, the anode electrode 18 may be formed with a transparent conductive material, such as indium tin oxide (ITO). In this case, the anode electrode 18 is placed on a surface of the phosphor layers 14 and the black layers 18 facing the second substrate 4. Furthermore, it is also possible to simultaneously provide an anode electrode based on a transparent conductive material, and a metallic layer for heightening the screen luminance.

As shown in FIG. 2, a plurality of spacers 20 are arranged between the first and the second substrates 2 and 4 to keep them spaced apart from each other by a predetermined distance. The spacers 20 are located corresponding to the non-light emission area of the black layers 16 such that they do not occupy the area of the phosphor layers 14.

The above-structured electron emission device is driven by applying predetermined voltages to the gate electrodes 6, the cathode electrodes 8 and the anode electrode 18 from the outside. For instance, a scan driving voltage is applied to any one of the cathode and the gate electrodes 8 and 6, a data driving voltage to the other electrode, and a positive voltage of several hundred to several thousand volts to the anode electrode 18.

Electric fields are formed around the electron emission regions 12 at the pixels where the voltage difference between the cathode and the gate electrodes 8 and 6 exceeds the threshold value, and electrons are emitted from the electron emission regions 12. The emitted electrons are attracted by the high voltage applied to the anode electrode 18, and collide against the phosphor layers 14 at the corresponding pixels, thereby light-emitting them.

With the electron emission device according to the present embodiment, the contact area between the electron emission region 12 and the isolated electrode 81 is enlarged so that the contact resistance is lowered, and the emission efficiency is heightened. The contact resistance between the isolated electrode 81 and the electron emission region 12 is not differentiated per the respective pixels so that the emission uniformity per pixel becomes enhanced.

Furthermore, when an electric field is formed around the electron emission region 12 and electrons are emitted from the electron emission region 12, a large amount of electrons are emitted from the peripheral side of the electron emission region 12 proximate to the gate electrode 6 as well as from the top surface thereof. That is, the larger the size of the effective electron emission area, the more the emission efficiency is effectively enhanced.

Furthermore, the electron emission region 12 and the gate electrode 6 are spaced apart from each other with a minute gap so that the intensity of electric field applied to the electron emission region 12 is maximized, and the leakage of current is minimized. Here, the distance between the electron emission region 12 and the gate electrode 6 indicates the distance of d1 measured along the surface of the first substrate 2.

Figure 4:
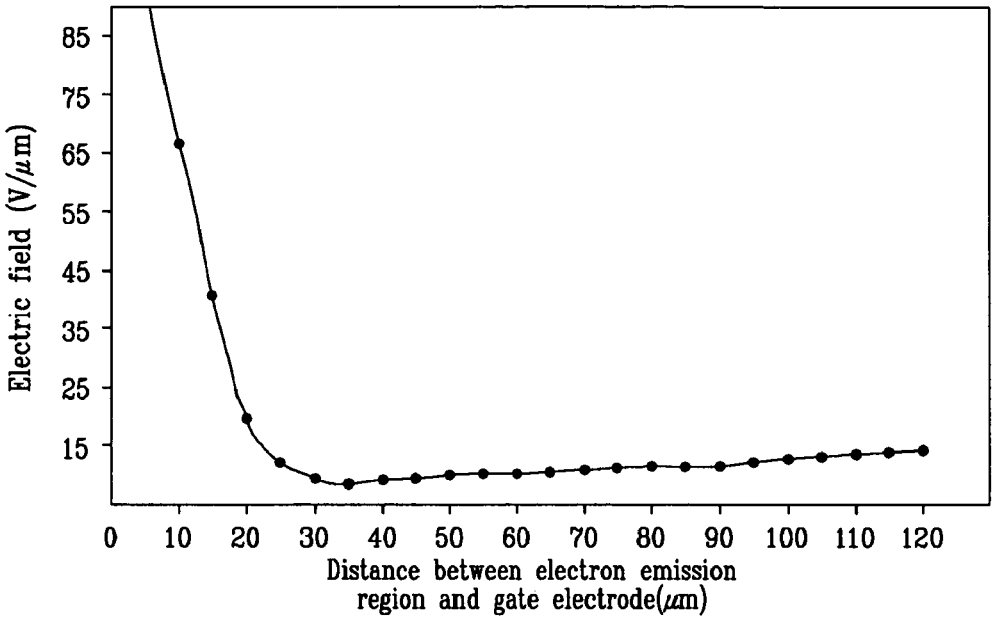
FIG. 4 is a graph illustrating the intensity of electric field as a function of the variation in the distance between an electron emission region and a gate electrode of the electron emission device according to the first embodiment of the present invention.
Figure 5:
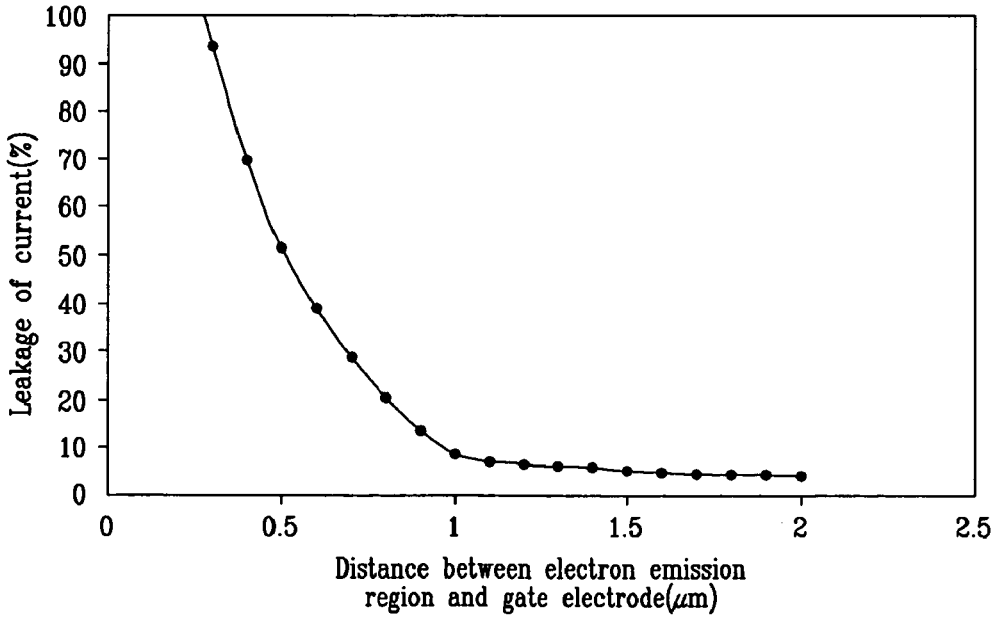
FIG. 5 is a graph illustrating the leakage of current as a function of the variation in the distance between the electron emission region and the gate electrode of the electron emission device according to the first embodiment of the present invention.

FIG. 4 is a graph illustrating the intensity of electric field as a function of the variation in the distance between the electron emission region and the gate electrode, and FIG. 5 is a graph illustrating the leakage of current as a function of the variation in the distance between the electron emission region and the gate electrode. The experiments were made on condition that 0V was applied to the cathode electrode, 100V to the gate electrode, and 1 kV to the anode electrode.

As shown in FIG. 4, as the distance between the electron emission region and the gate electrode was decreased, the intensity of electric field was slightly decreased. When the distance between the electron emission region and the gate electrode was 30 μm or less, the intensity of electric field was radically increased. In view of such experimental results, the distance between the electron emission region and the gate electrode, in some embodiments, is established to be 30 μm or less. Furthermore, when the distance between the electron emission region and the gate electrode was 15 μm or less, the intensity of electric field applied to the electron emission region exceeded 60 V/μm. Therefore, the distance between the electron emission region and the gate electrode in some embodiments is established to be 15 μm or less.

As shown in FIG. 5, when the distance between the electron emission region and the gate electrode was 2 μm or less, as the distance between the electron emission region and the gate electrode was decreased, the leakage of current was slowly increased. When the distance between the electron emission region and the gate electrode was less than 1 μm, the leakage of current was radically increased. In view of the experimental results, the distance between the electron emission region and the gate electrode, in some embodiments, is established to be 1 μm or more.

As described above, in this embodiment, the distance between the electron emission region and the gate electrode is established to be 1-30 μm, particularly to be 1-15 μm. With such a condition, the driving failure due to the leakage of current is prevented, and the intensity of electric field is maximized to thereby enhance the emission efficiency.

Figure 6:
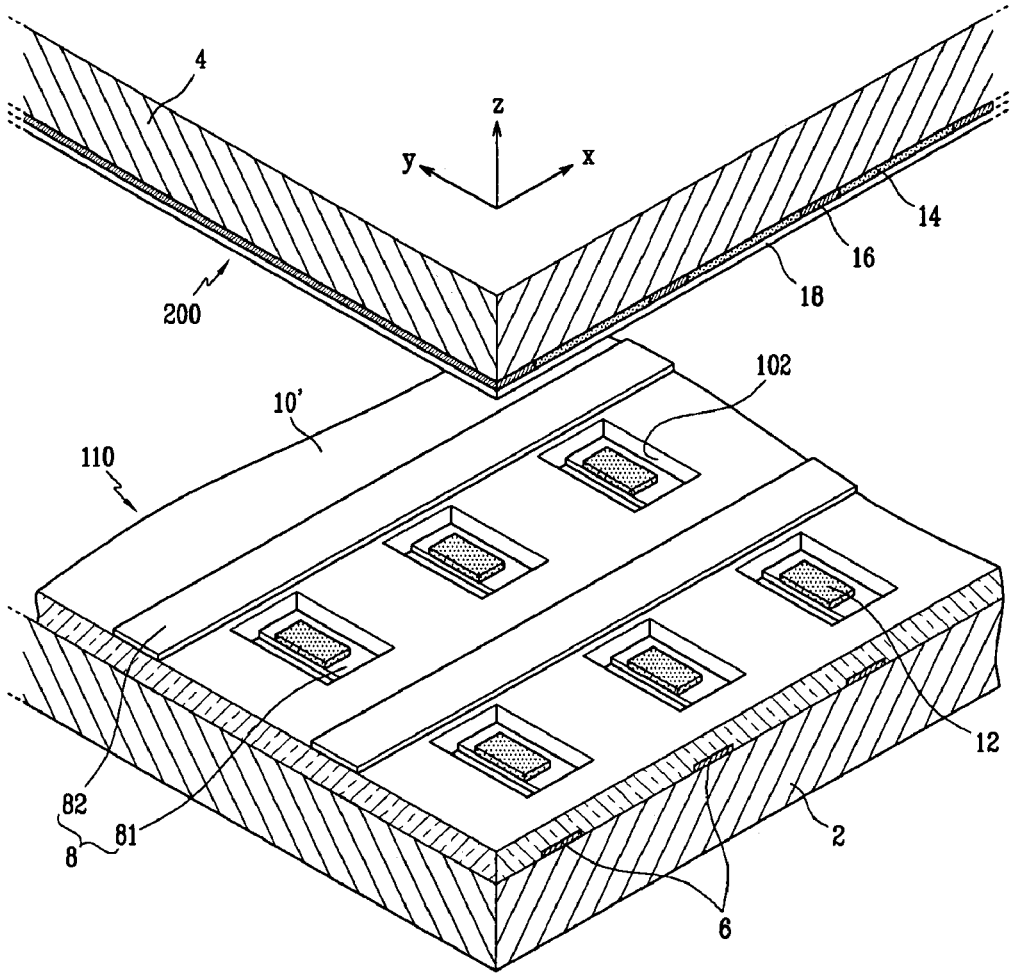
FIG. 6 is a partial exploded perspective view of an electron emission device according to a second embodiment of the present invention.

As shown in FIG. 6, with an electron emission device according to a second embodiment of the present invention, the electron emission unit 110 basically has the same structural components as those related to the first embodiment except that it has an insulating layer 10' formed on the entire surface of the first substrate 2. Openings 102 are formed at the insulating layer 10' while exposing an entire area of the electron emission regions 12 and a part of the gate electrodes 6. The plane shape and size of the openings 102 are not limited to the illustrated, but may be varied on condition that they do not intercept the trajectories of the electron beams.

Figure 7:
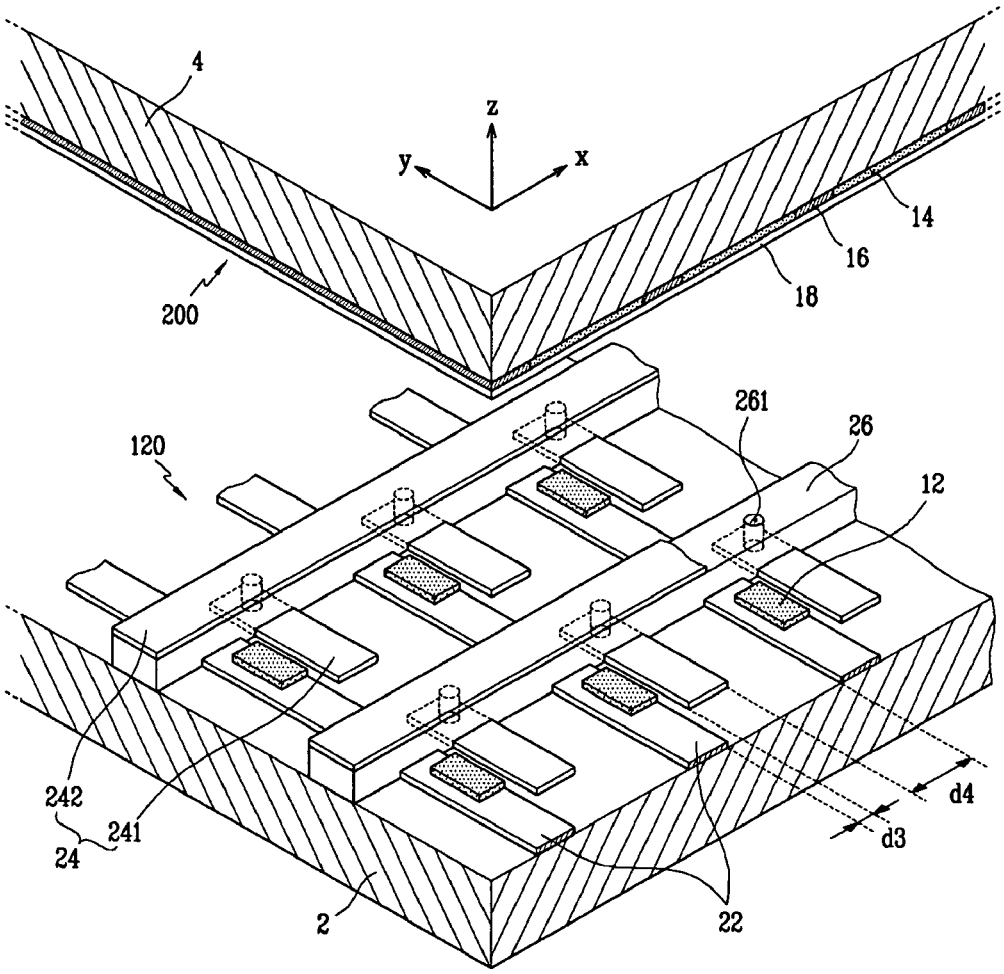
FIG. 7 is a partial exploded perspective view of an electron emission device according to a third embodiment of the present invention.

As shown in FIG. 7, in an electron emission device according to a third embodiment of the present invention, the electron emission unit 120 has stripe-patterned cathode electrodes 22, and gate electrodes 24 with isolated electrodes 241 and line electrodes 242.

In this embodiment, cathode electrodes 22 are stripe-patterned on the first substrate 2 in a direction of the first substrate 2, and isolated electrodes 241 of gate electrodes 24 are separately located at the respective pixel regions defined on the first substrate 2 while being spaced apart from the cathode electrodes 22 by a predetermined distance. When the isolated electrode 241 is spaced apart from the cathode electrode 22 at the relevant pixel by a distance of d3, it is spaced apart from the cathode electrode 22 at the other pixel neighboring thereto by a distance of d4, which is larger than the distance of d3.

An insulating layer 26 is formed perpendicular to the cathode electrodes 22 while partially covering the cathode electrodes 22 and the isolated electrodes 241, and line electrodes 242 of gate electrodes 24 are formed on the insulating layer 10. The line electrodes 242 contact the isolated electrodes 241 placed along the length of the line electrodes 242 through via holes 261 formed at the insulating layer 10, and are electrically connected thereto. Electron emission regions 12 are formed on the cathode electrodes 22 along the peripheral sides of the cathode electrodes 22 proximate to the isolated electrodes 241 at the relevant pixels.

In this embodiment, the line electrodes 242 of the gate electrodes 24 receive the driving voltages from the outside, and apply them to the isolated electrodes 241 while forming electric fields required for the electron emission from the top of the electron emission regions 12. The isolated electrodes 241 are placed on the same plane as the cathode electrodes 22, and form electric fields for the electron emission from the lateral surface of the electron emission regions 12.

With the electron emission device according to the present embodiment, in operation, a large amount of electrons are emitted from the one-sided periphery of the electron emission region 12 proximate to the isolated electrode 241, the other peripheral side thereof proximate to the line electrode 242 and the top surface thereof. Consequently, the electron emission region has a large effective electron emission portion, thereby enhancing the emission efficiency.

The distance of d3 between the electron emission region 12 and the isolated electrode 241 is established to be 1 μm or more, thereby minimizing the leakage of current. The distance between the electron emission region 12 and the isolated electrode 241 is established to be 30 μm or less, particularly to be 15 μm or less, thereby maximizing the intensity of the electric field applied to the electron emission region 12.

Figure 8:
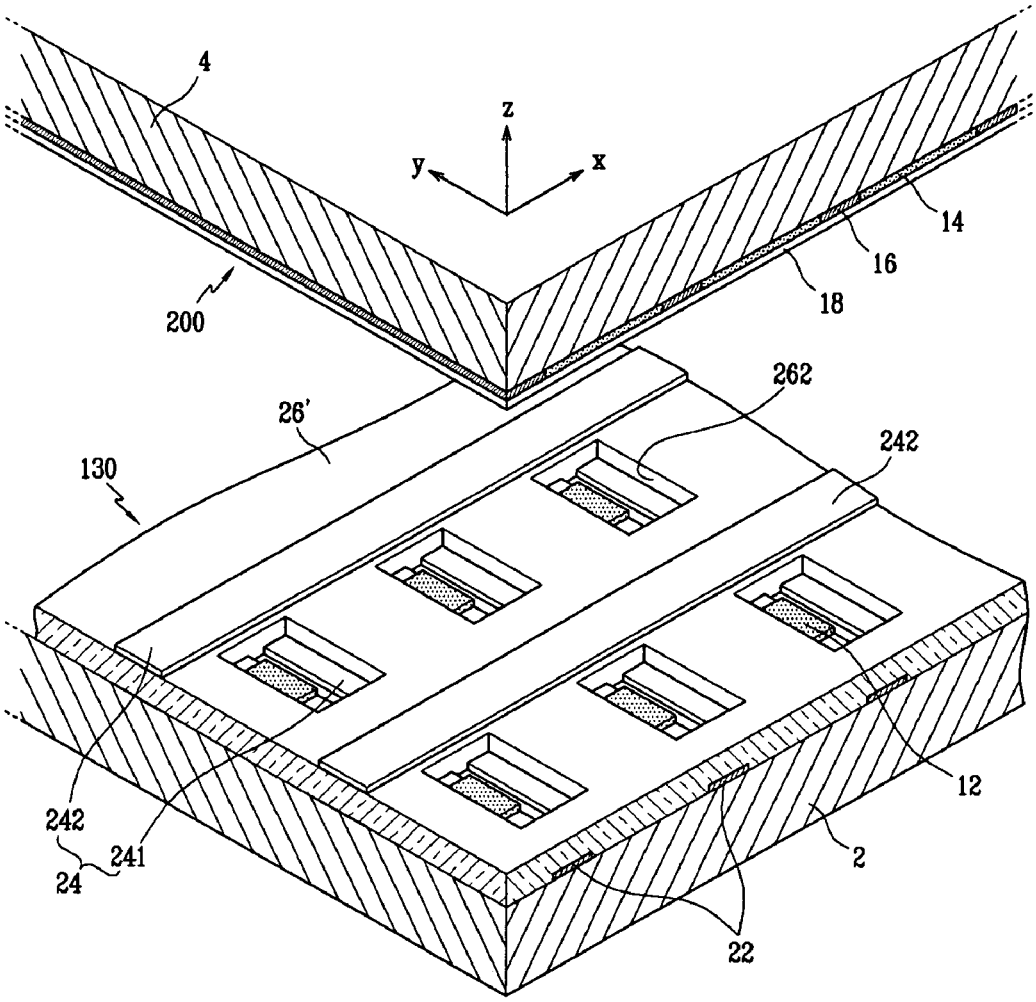
FIG. 8 is a partial exploded perspective view of an electron emission device according to a fourth embodiment of the present invention.

As shown in FIG. 8, with an electron emission device according to a fourth embodiment of the present invention, the electron emission unit 130 basically has the same structural components as those related to the third embodiment except that it has an insulating layer 26' formed on the entire surface of the first substrate 2. Openings 262 for passing the electron beams are formed at the insulating layer 26' while exposing an entire area of the electron emission regions 12 and a part of the isolated electrodes 241. The plane shape and size of the openings 262 are not limited to the illustrated, but may be altered in various manners on condition that they do not intercept the trajectories of electron beams.

A method of manufacturing the electron emission device according to the first embodiment will now be explained with reference to FIGS. 9A to 9E.

Figure 9A:
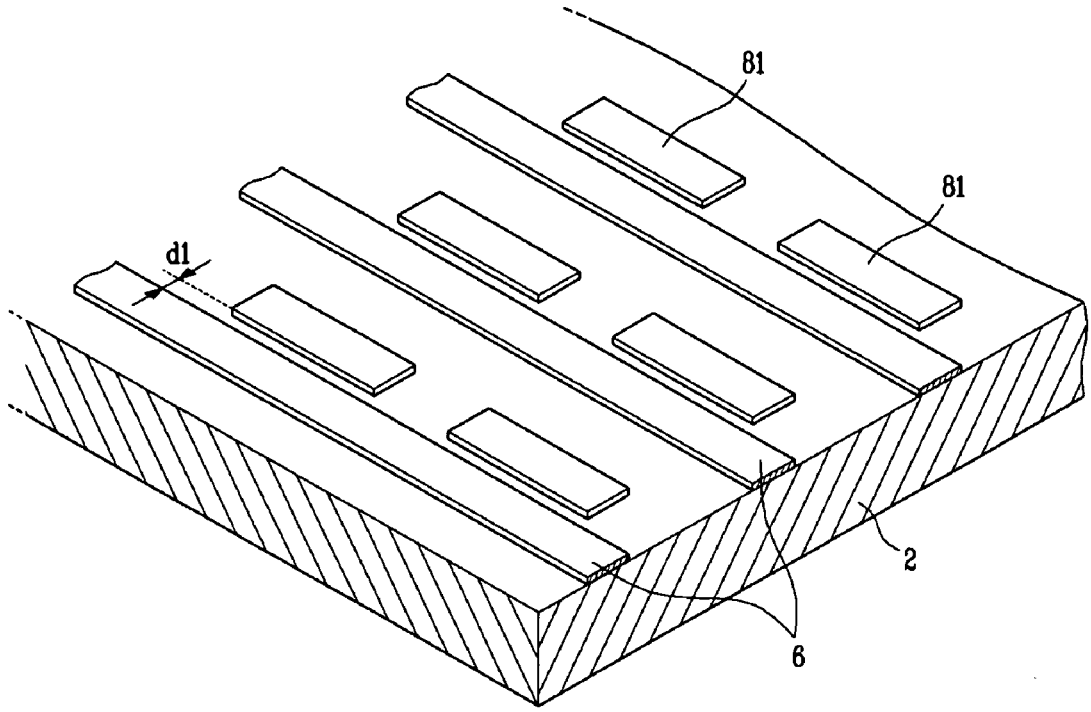
FIG. 9A illustrates a first phase of manufacturing the electron emission device according to the first embodiment of the present invention.

First, as shown in FIG. 9A, a conductive film is coated onto a first substrate 2, and patterned to thereby form isolated electrodes 81 of cathode electrodes, and gate electrodes 6. The isolated electrodes 81 are separately formed at the respective pixel regions defined on the first substrate 2. The gate electrodes 6 are stripe-patterned on the first substrate 2 in a first direction thereof. The distance of d1 between the gate electrode 6 and the isolated electrode 81 is established to be 1-30 μm, particularly to be 1-15 μm.

The isolated electrodes 81 and the gate electrodes 6 may be simultaneously formed with a transparent oxide material, such as ITO. Alternatively, only the isolated electrodes 81 are formed with a transparent oxide material, while the gate electrodes 6 are formed with a metallic material having a specific resistance lower than the ITO, such as chromium, aluminum, silver, molybdenum, tungsten, copper, gold, and platinum.

Figure 9B:
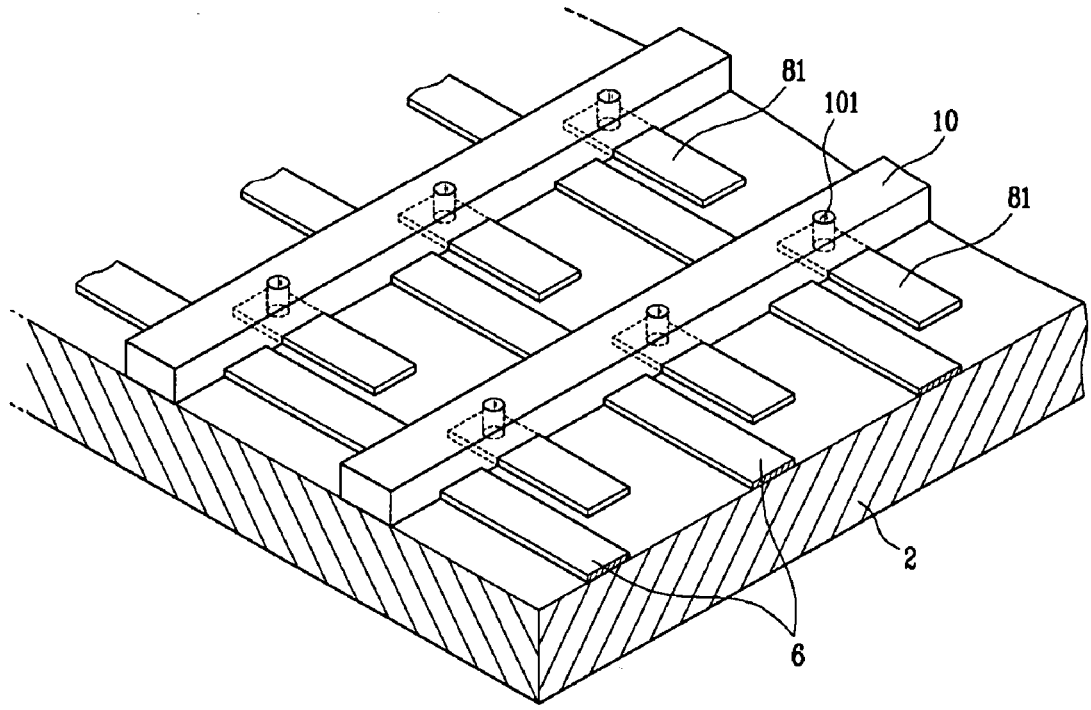
FIG. 9B illustrates a second phase of manufacturing the electron emission device according to the first embodiment of the present invention.
Figure 9C:
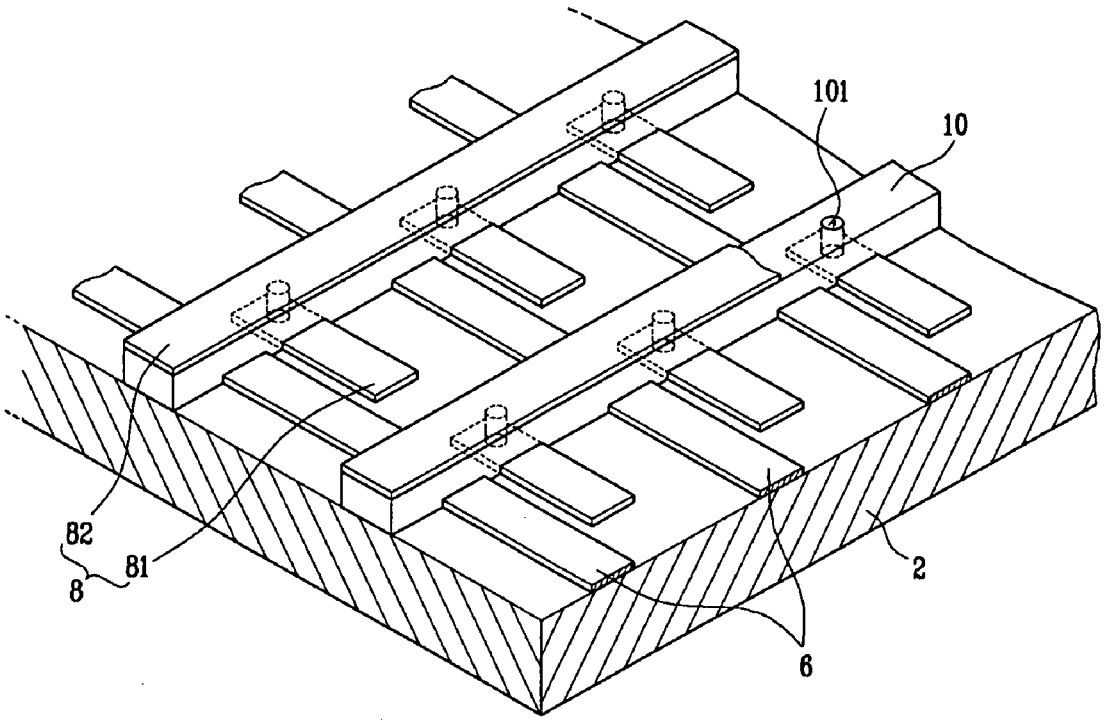
FIG. 9C illustrates a third phase of manufacturing the electron emission device according to the first embodiment of the present invention.

Thereafter, as shown in FIG. 9B, an insulating layer 10 is formed perpendicular to the gate electrodes 6 while partially covering the gate electrodes 6 and the isolated electrodes 81, and partially etched to thereby form via holes 101 over the isolated electrodes 81. As shown in FIG. 9C, line electrodes 82 of cathode electrodes 8 are formed on the insulating layer 10. Then, the conductive material of the line electrodes 82 contacts the isolated electrodes 81 through the via holes 101 such that the line and the isolated electrodes 82 and 81 are electrically connected to each other.

Figure 9D:
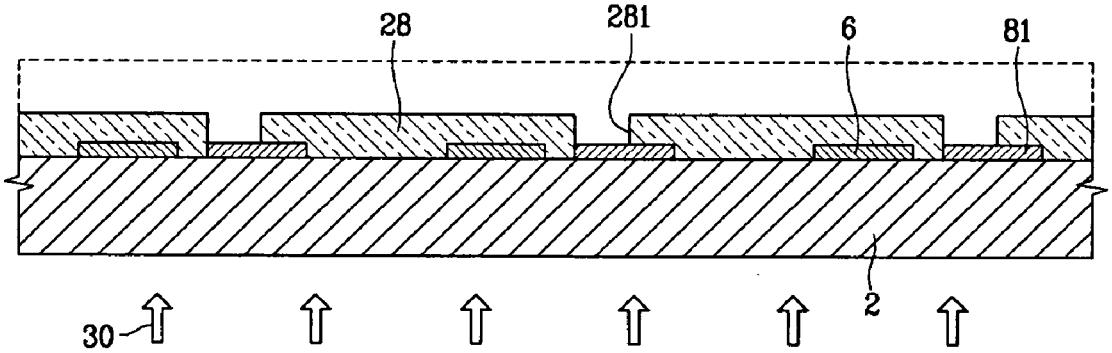
FIG. 9D illustrates a fourth phase of manufacturing the electron emission device according to the first embodiment of the present invention.
Figure 9E:
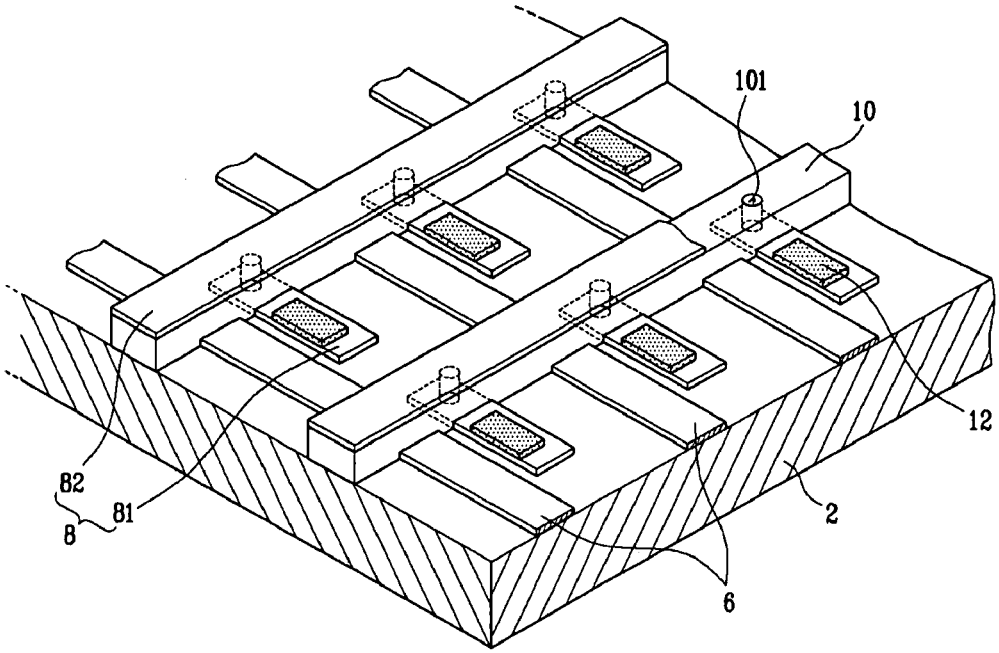
FIG. 9E illustrates a fifth phase of manufacturing the electron emission device according to the first embodiment of the present invention.

As shown in FIG. 9D, a sacrificial layer 28 is formed on the entire surface of the first substrate 2, and patterned to thereby form openings 281 corresponding to the locations of electron emission regions.

An organic material, such as vehicle and binder, and a photosensitive material are mixed with a powdered electron emission material to prepare a paste-phased mixture with a viscosity suitable for the printing. The mixture is screen-printed onto the first substrate 2, and ultraviolet rays 30 are illuminated thereto from the backside of the first substrate 2 to selectively harden the mixture filled within the openings 281 of the sacrificial layer 28. The non-hardened mixture is removed through developing, and the sacrificial layer is detached, followed by drying and firing the remaining mixture to thereby form electron emission regions 12 shown in FIG. 9E.

The first substrate 2 is formed with a transparent material, and the isolated electrodes 81 are formed with a transparent oxide material, such as ITO. With the backside exposure technique, the mixture is hardened from the surface of the isolated electrodes 81, and hence, the electron emission regions 12 are well attached to the isolated electrodes 81. Consequently, the hardened mixture is not detached during the developing process, and the contact resistance between the isolated electrode 81 and the electron emission region 12 is extremely low.

Alternatively, the electron emission regions 12 may be formed without using the sacrificial layer 28. A paste-phased mixture with no photosensitive material is partially printed onto the isolated electrodes 81 using a screen mesh (not shown), and dried and fired. Furthermore, the electron emission regions 12 may be formed through direct growth, sputtering, or chemical vapor deposition.

It is also possible that the insulating layer 10 is formed on the entire surface of the first substrate 2, and openings 102 shown in FIG. 6 are formed at the insulating layer 10 while partially exposing the isolated electrodes 81 and the gate electrodes 6 to be placed with the electron emission regions. Then, the electron emission device according to the second embodiment of the present invention can be completed.

A method of manufacturing the electron emission device according to the third embodiment of the present invention will be now explained with reference to FIGS. 10A to 10D.

Figure 10A:
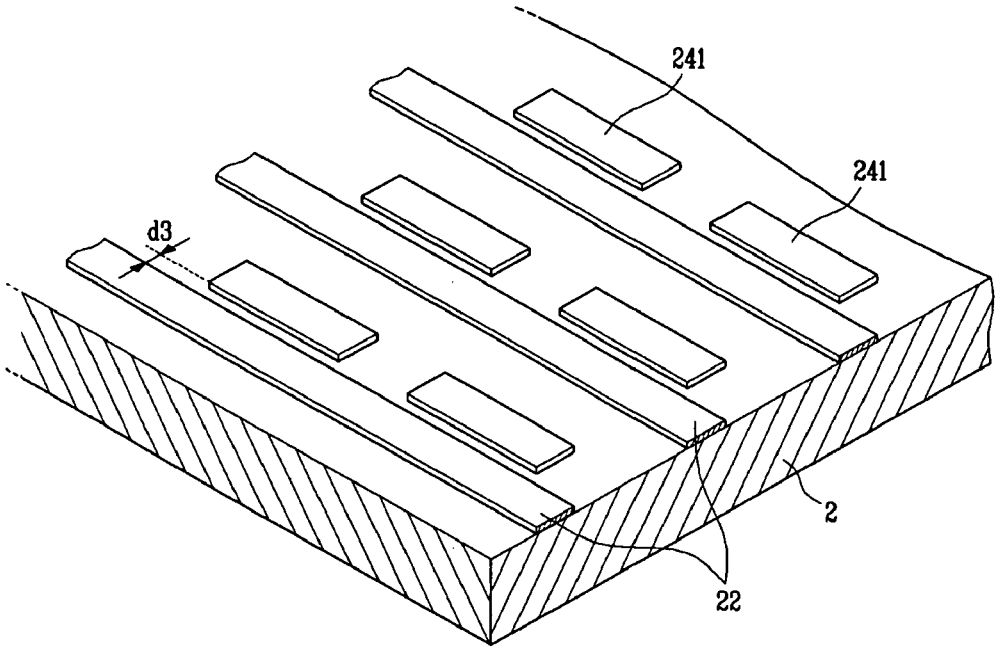
FIG. 10A illustrates a first phase of manufacturing the electron emission device according to the third embodiment of the present invention.

First, as shown in FIG. 10A, a conductive film is coated onto a first substrate 2, and patterned to thereby form isolated electrodes 241 of gate electrodes and cathode electrodes 22. The isolated electrodes 241 are separately formed at the respective pixel regions defined on the first substrate 2, and cathode electrodes 22 are stripe-patterned on the first substrate 2 in a first direction thereof. The distance of d3 between the cathode electrode 22 and the isolated electrode 241 is established to be 1-30 μm, particularly to be 1-15 μm.

The isolated electrodes 241 and the cathode electrodes 22 may be simultaneously formed with a transparent oxide material, such as ITO. Alternatively, it is possible that only the cathode electrodes 22 are formed with a transparent oxide material, while the isolated electrodes 241 are formed with a metallic material having a specific resistance lower than the ITO, such as chromium, aluminum, silver, molybdenum, tungsten, copper, gold, and platinum.

Figure 10B:
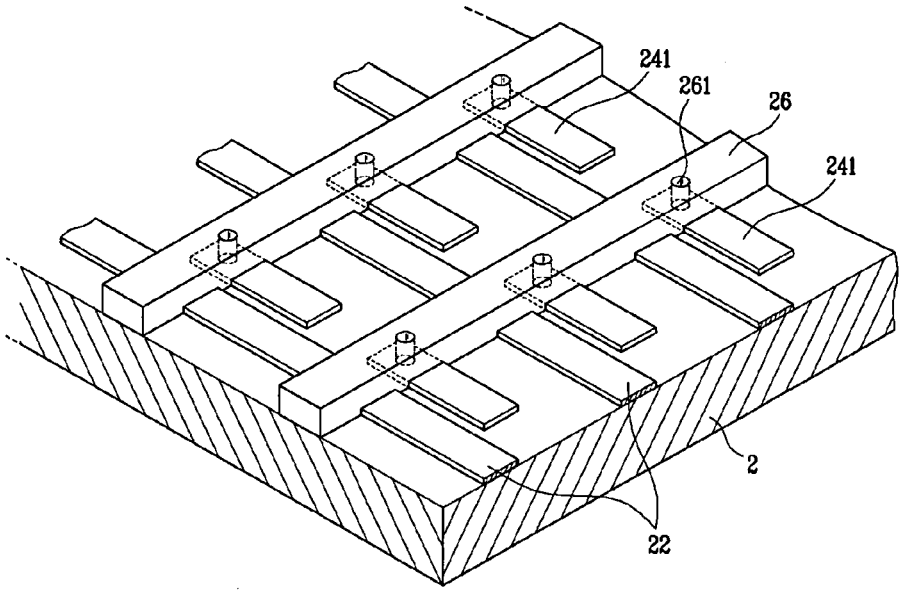
FIG. 10B illustrates a second phase of manufacturing the electron emission device according to the third embodiment of the present invention.
Figure 10C:
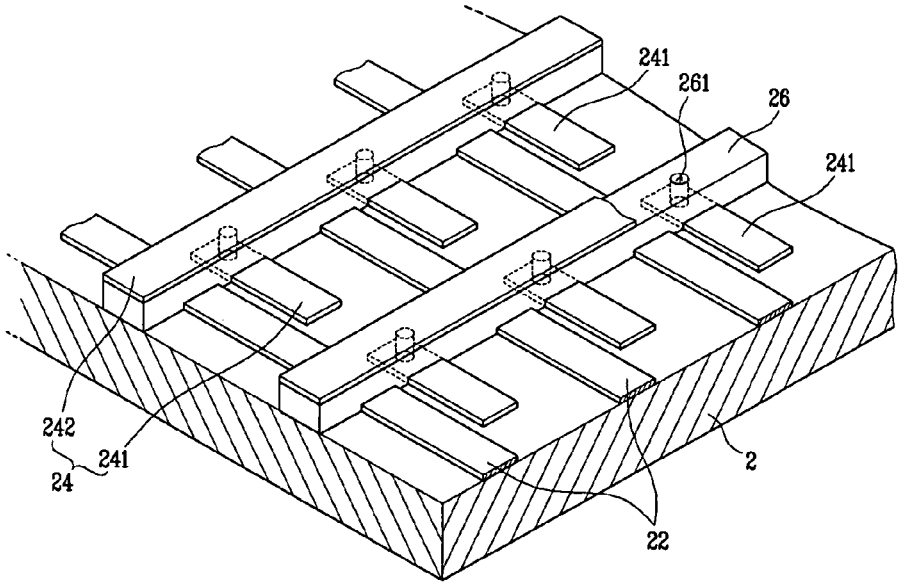
FIG. 10C illustrates a third phase of manufacturing the electron emission device according to the third embodiment of the present invention.

Thereafter, as shown in FIG. 10B, an insulating layer 26 is formed perpendicular to the cathode electrodes 22 while partially covering the cathode electrodes 22 and the isolated electrodes 241, and partially etched to thereby form via holes 261 over the isolated electrodes 241. As shown in FIG. 10C, line electrodes 242 of gate electrodes 24 are formed on the insulating layer 26. Then, the conductive material of the line electrodes 242 contacts the isolated electrodes 241 through the via holes 261 such that the line and the isolated electrodes 242 and 241 are electrically connected to each other.

Figure 10D:
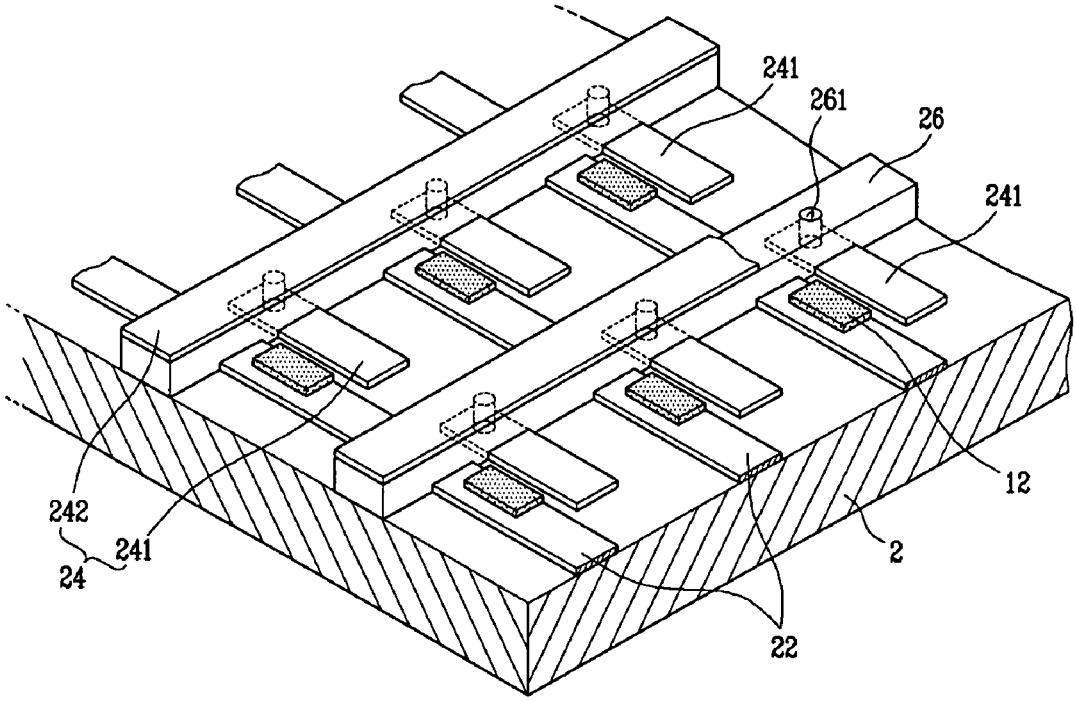
FIG. 10D illustrates a fourth phase of manufacturing the electron emission device according to the third embodiment of the present invention.

As shown in FIG. 10D, electron emission regions 12 are formed on the cathode electrodes 22 along the peripheral sides of the cathode electrodes 22 proximate to the isolated electrodes 241. The electron emission regions 12 may be formed in the same way as with the process related to the first embodiment.

It is also possible that the insulating layer 26 is formed on the entire surface of the first substrate 2, and openings 262 shown in FIG. 8 are formed at the insulating layer 26 while partially exposing the cathode electrodes 22 and the isolated electrodes 241 to be placed near the electron emission regions 12. Then, the electron emission device according to the fourth embodiment of the present invention can be completed.

Although exemplary embodiments of the present invention have been described in detail hereinabove, it should be clearly understood that many variations and/or modifications of the basic inventive concept herein taught which may appear to those skilled in the art will still fall within the spirit and scope of the present invention, as defined in the appended claims and their equivalents.

What is claimed is:

1. An electron emission device comprising:

first electrodes on a substrate and extending in a first direction of the substrate;

isolation electrodes on a same plane as the first electrodes, each isolation electrode being spaced apart from a respective one of the first electrodes, the isolation electrodes being separately arranged in the first direction as well as in a second direction crossing the first direction;

line electrodes placed on a different plane from the first electrodes and the isolation electrodes and located on an insulating layer, wherein the insulating layer is between the substrate and the line electrodes, each of the line electrodes being electrically connected to a respective plurality of the isolation electrodes arranged along the second direction to form a second electrode together with the respective plurality of the isolation electrodes; and electron emission regions on top of the isolation electrodes along peripheral sides of the isolation electrodes proximate to the first electrodes, wherein a distance between the substrate and the line electrodes is larger than a distance between the substrate and the first electrodes as well as a distance between the substrate and the isolation electrodes.

2. The electron emission device of claim 1, wherein the isolation electrodes are separately located at respective pixel regions defined on the substrate.

3. The electron emission device of claim 1, wherein the insulating layer is under the line electrodes and has a same width as the line electrodes.

4. The electron emission device of claim 1, wherein the insulating layer is on an entire surface of the substrate with openings for passing electron beams.

5. The electron emission device of claim 1, wherein the first electrodes are respectively spaced apart from the respective electron emission regions by a gap of 1-30 μm.

6. The electron emission device of claim 1, wherein the electron emission regions are formed with at least one material selected from the group consisting of carbon nanotube, graphite, graphite nanofiber, diamond, diamond-like carbon, $C_{60}$, and silicon nanowire.

7. An electron emission device comprising:

first electrodes on a substrate and extending in a first direction of the substrate;

isolation electrodes on a same plane as the first electrodes, each respective one of the isolation electrodes being spaced apart from a respective one of the first electrodes, the isolation electrodes being separately arranged in the first direction as well as in a second direction crossing the first direction;

line electrodes placed on a different plane from the first electrodes and the isolation electrodes and located on an insulating layer, wherein the insulating layer is between the substrate and the line electrodes, each of the line electrodes being electrically connected to a respective plurality of the isolation electrodes arranged along the second direction to thereby form a second electrode together with the respective plurality of the isolation electrodes; and electron emission regions on top of the first electrodes along peripheral sides of the first electrodes proximate to the isolation electrodes, wherein a distance between the substrate and the line electrodes is larger than a distance between the substrate and the first electrodes as well as a distance between the substrate and the isolation electrodes.

8. The electron emission device of claim 7, wherein the isolation electrodes are separately located at respective pixel regions defined on the substrate.

9. The electron emission device of claim 7, wherein the insulating layer is under the line electrodes and has a same width as the line electrodes.

10. The electron emission device of claim 7, wherein the insulating layer is on an entire surface of the substrate with openings for passing electron beams.

11. The electron emission device of claim 7, wherein the isolation electrodes are respectively spaced apart from the respective electron emission regions by a gap of 1-30 μm.

12. The electron emission device of claim 7, wherein the electron emission regions are formed with at least one material selected from the group consisting of carbon nanotube, graphite, graphite nanofiber, diamond, diamond-like carbon, $C_{60}$, and silicon nanowire.

13. An electron emission device comprising:

first electrodes on a substrate and extending in a first direction of the substrate;

isolation electrodes on a same plane as the first electrodes, each of the isolation electrodes spaced apart from a respective one of the first electrodes, the isolation electrodes being separately arranged in the first direction as well as in a second direction crossing to the first direction;

line electrodes placed over the first electrodes and the isolation electrodes and located on an insulating layer, wherein the insulating layer is between the substrate and the line electrodes, each of the line electrodes being electrically connected to a respective plurality of the isolation electrodes arranged along the second direction through a via hole formed in the insulating layer to thereby form a second electrode together with the respective plurality of the isolation electrodes; and electron emission regions on top of the first electrodes or the isolation electrodes, wherein a distance between the substrate and the line electrodes is larger than a distance between the substrate and the first electrodes as well as a distance between the substrate and the isolation electrodes.

14. The electron emission device of claim 13, wherein the isolation electrodes are separately located at respective pixel regions defined on the substrate.

15. The electron emission device of claim 13, wherein the electron emission regions have peripheries aligned with respective peripheral sides of the first electrodes proximate to the isolation electrodes, or to peripheral sides of the isolation electrodes proximate to the first electrodes.

16. The electron emission device of claim 15, wherein the first electrodes are respectively spaced apart from the respective isolation electrodes by a gap of 1-30 μm.

17. A method of manufacturing an electron emission device comprising:

forming first electrodes on a substrate in a first direction of the substrate, and separately forming isolation electrodes arranged in the first direction as well as in a second direction crossing the first direction such that each of the isolation electrodes is spaced apart from a respective one of the first electrodes by a distance;

forming an insulating layer on the substrate such that the insulating layer partially covers the first electrodes and the isolation electrodes;

forming via holes in the insulating layer while partially exposing a surface of the isolation electrodes;

forming line electrodes on the insulating layer, wherein the insulating layer is between the substrate and the line electrodes, such that each of the line electrodes is electrically connected to at least one of the isolation electrodes through the via holes, thereby forming second electrodes with the isolation electrodes and the line electrodes; and forming electron emission regions on top of the first electrodes or the isolation electrodes.

18. The method of claim 17, wherein the first electrodes are respectively spaced apart the respective isolation electrodes by a gap of 1-30 μm.

19. The method of claim 17, wherein the first electrodes are formed with a transparent oxide film, and the electron emission regions are formed on the first electrodes.

20. The method of claim 17, wherein the isolation electrodes are formed with a transparent oxide film, and the electron emission regions are formed on the isolation electrodes.

* * * * *

UNITED STATES PATENT AND TRADEMARK OFFICE

CERTIFICATE OF CORRECTION

PATENT NO. : 7,649,308 B2
APPLICATION NO. : 11/348739
DATED : January 19, 2010
INVENTOR(S) : Sang-Jo Lee et al.

It is certified that error appears in the above-identified patent and that said Letters Patent is hereby corrected as shown below:

In the Claims

Column 12, Claim 18, line 43 After "apart" Insert -- from --

Signed and Sealed this
Thirteenth Day of September, 2011

David J. Kappos

David J. Kappos
*Director of the United States Patent and Trademark Office*